US005535696A

United States Patent [19]

Ordinachev

[11] Patent Number: 5,535,696

[45] Date of Patent: Jul. 16, 1996

[54] COMPOSITE BOATHOUSE

[76] Inventor: Mark Ordinachev, 101 W. 40th St., Sioux Falls, S. Dak. 57105

[21] Appl. No.: 240,243

[22] Filed: May 10, 1994

[51] Int. Cl.[6] ..... B63B 35/44

[52] U.S. Cl. ..... 114/263; 14/27

[58] Field of Search ..... 114/263, 264, 114/265, 266, 267, 250; 14/27

[56] References Cited

U.S. PATENT DOCUMENTS 3,112,504 12/1963 Carlton ..... 114/250

4,838,735 6/1989 Warner ..... 114/263

FOREIGN PATENT DOCUMENTS 1501932 9/1967 France ..... 114/266

9014264 11/1990 WIPO ..... 114/266

*Primary Examiner*—Jesus D. Sotelo

[57] ABSTRACT

A composite structure suitable for a floating or portable dwelling composed of a plurality of units connected together by loose connections to links usable for being walked on.

5 Claims, 2 Drawing Sheets

COMPOSITE BOATHOUSE

BACKGROUND AND SUMMARY OF THE INVENTION

This invention pertains particularly to floating units usable as a multiple part house or as auxiliary shelters in conjunction with a home or simply as auxiliary shelters adapted to be anchored on the water. Although described principally as floating units, there may be applications in which a land-based mode would be useful.

There are several factors indicating the desirability of a floating or portable home. Among these factors are the increasing scarcity of land area along coast or shorelines. Further, particularly for second homes, the portability of a floating home may be attractive to many people.

Floating residences are not new. However, a residence confined to a single unit requires a relatively large hull in order to float the weight of a full living unit plus any auxiliary shelters that may be desired for boating or fishing equipment or the like. Therefore, multiple units appear desirable.

By the present invention multiple units are loosely linked together so that each unit floats independently. Walkways between the units are provided above water level to join the individual units.

DESCRIPTION

Briefly, this invention comprises a composite unit designed to serve as a floating residence combined with auxiliary structures.

Figure 1:
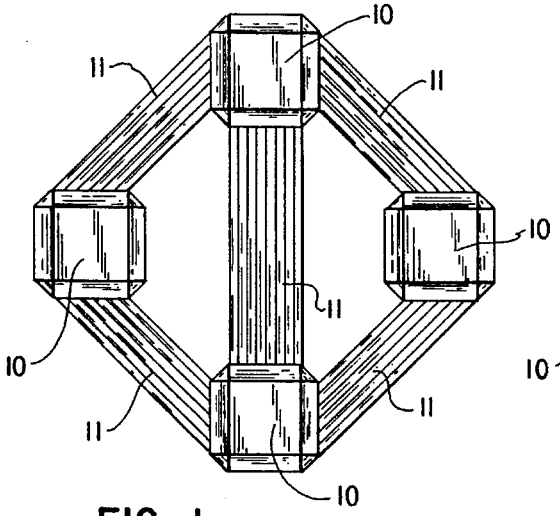
FIG. 1 is a plan view of one arrangement of individual units.
Figure 2:
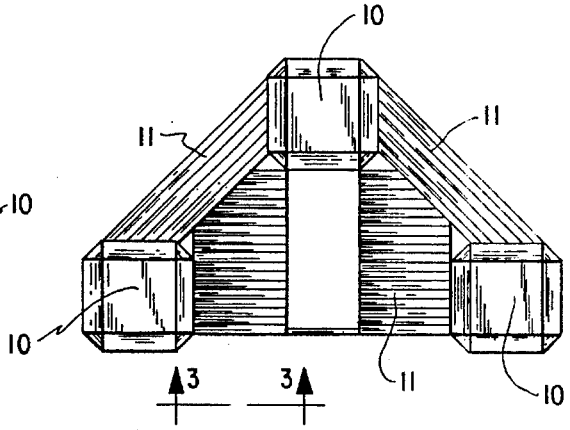
FIG. 2 is a plan view of an alternative arrangement.

More specifically and referring to the drawings, this novel device comprises a series of floating structures 10 joined together by walkways 11. The walkways are loosely connected to each structure to form a unified assembly. Generally an assembly of four structures 10 as shown in FIG. 1 would be considered. However, it will be apparent that many different arrangements would be possible. Different angles at the ends of the walkways 11 might be desirable for a six unit assembly—or for a three unit assembly if it were to be equilateral, but it is evident that many configurations are possible.

Figure 3:
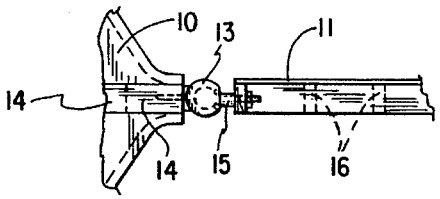
FIG. 3 is a partial elevational view from line 3—3 of FIG. 2 showing one made of attachment.

The attachment between the walkway 11 and the structure 10 may be of several types also. In FIGS. 3–6, three different types are illustrated. FIG. 3 shows that a ball and socket type device is readily usable. A socket member 13 may be fixed to a rib 14 of the structure 10. The ball member 15 is attached to a cross member 16 of the walkway 11 and then can be engaged with the socket 13 thus providing a relatively flexible joint which can allow wave action between the unit structures without great stress.

Figure 4:
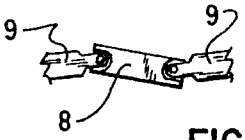
FIG. 4 is a view similar to FIG. 3 of an alternate attachment.

A second kind of device for attachment of the parts is shown in FIG. 4. This connector provides a double universal joint to allow the needed flexibility. The end pieces 9 of the joint are attached to the unit structures and the joint intermediate section 8 allows a certain amount of flexibility.

Figure 5:
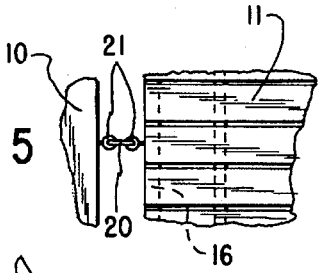
FIG. 5 is a view of still another alternate attachment device.
Figure 6:
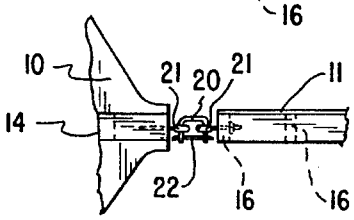
FIG. 6 is a side elevational view of the device of FIG. 5.

A similar attachment is shown in FIGS. 5 and 6. In this device, the fastening is done by use of a clevis 20 or similar U-shaped piece engaged in a pair of eye-bolts 21 or the like. A link 22 is used to close the clevis 20.

It will now be clear that the unit structures 10 can be loosely linked by attaching the crosswalks 11 in a continuous linkage with the units. The free movement built into the attachment devices, whether ball and socket or clevis type, allows each unit 10 to float freely without strain on the crosswalks or the attachment devices.

Figure 7:
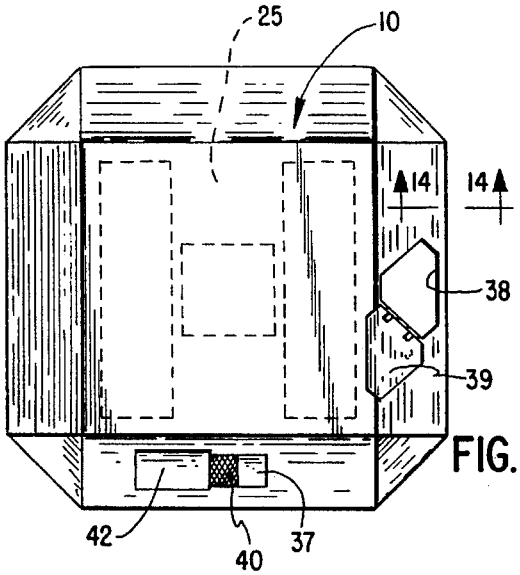
FIG. 7 is a top plan view of one unit showing one possible floor plan of an auxiliary unit.
Figure 15:
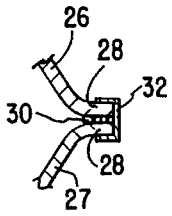
FIG. 15 is a view similar to FIG. 14 of an alternative means of assembling the parts of the unit structures.
Figure 14:
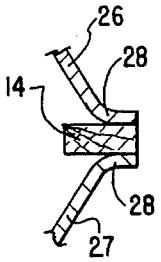
FIG. 14 is a sectional view from line 14—14 of FIG. 7.
Figure 8:
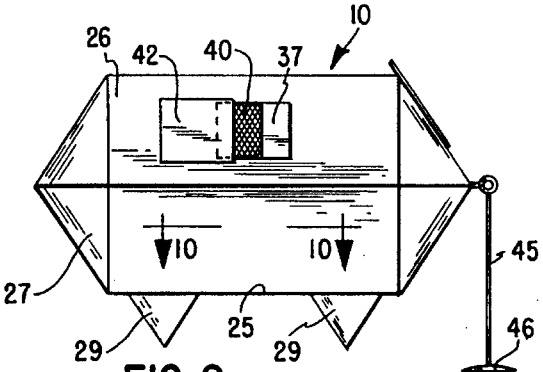
FIG. 8 is a front elevational view of a single unit showing alternate V-shaped keels.
Figure 9:
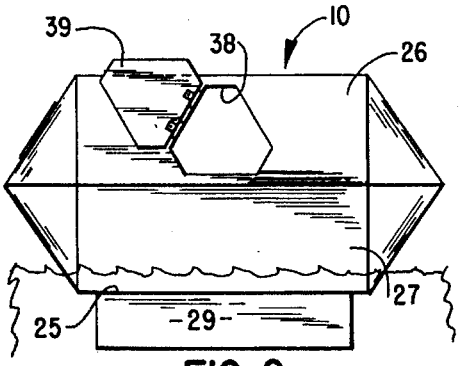
FIG. 9 is a side elevational view of the unit of FIG. 8.

As best shown in FIGS. 7, 8 and 9, the unit structures 10 preferably have a rectangular or square base 25 which is normally below the waterline. The structure tapers outwardly as it rises to a joint line normally above the waterline. A top member 26 of mirror-image shape to the bottom section 27 is then joined to the bottom section through flanges 28 (FIGS. 14 and 15) joined by an intermediate rib 14. The rib, as an alternative, may be replaced by a rubber or rubberized gasket 30, and the entire assembly sealed by a channel shaped strip 32 holding the flanges 28 tightly against the gasket 30. Both top and bottom members or sections may be formed from metal or wood, but are preferably a moldable plastic such as fiber glass. V-shaped hulls 29 may be formed on the bottom of the unit. Such hulls are particularly useful when the units are being moved to a new location or the like. Then the hulls can maintain better alignment as each unit is towed either individually or in groups. The hull may also provide some additional stability when the group is assembled and floating while tethered. Where the units are more permanently placed and when less wave action is desired, it is envisioned that permanent support braces 45 may be used to hold the unit structure. A foot 46 adapted to stand on the sea bed or lake bed or simply on land may be desirable where the land is soft or shifting. It will be understood that the support brace 45 may be vertically adjustable by any of the number of means such as a hydraulic piston and cylinder arrangement.

Figure 10:
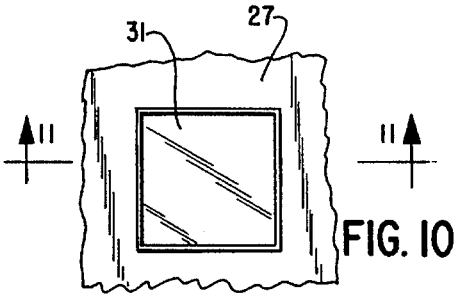
FIG. 10 is a view from line 10—10 of FIG. 8.
Figure 11:
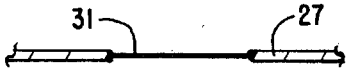
FIG. 11 is a sectional view from line 11—11 of FIG. 10.

Each of the unit structures may have a particular use. For example, one could be used as a sleeping and living room; another a kitchen eating area. They may also be specific as to the use. For example, the unit of FIG. 10 illustrates the possible use of the unit as a "glass bottomed" boat. As shown in that figure, the bottom section or floor 27 may be fitted with a glass panel 31 which will allows occupant of such a unit to see the flora and fauna of the underwater area within sight range of the panel.

Figure 13:
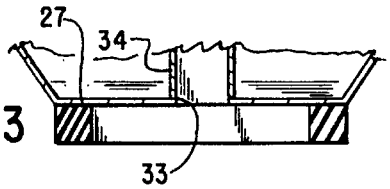
FIG. 13 is a sectional view from line 13—13 of FIG. 12.
Figure 12:
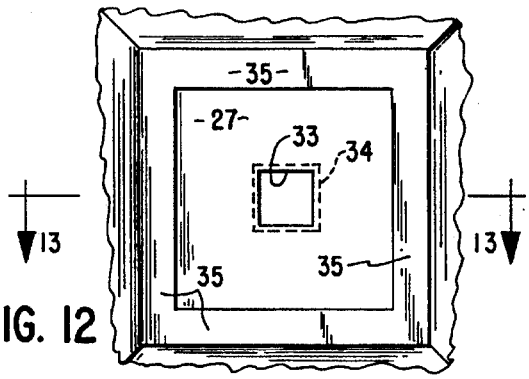
FIG. 12 is a view similar to FIG. 10 of an alternative bottom floor of the unit.

Another possible special use unit is shown in FIGS. 12 and 13. This unit has an opening 33 in the floor 27 and structures around that opening to build a fishing opening or well 34. The structure includes sides high enough to prevent overflow of water into the unit. Benches 35 may be provided around the well 34 for seating a plurality of people who may want to fish. This kind of unit may be useful in both very hot or cold weather to provide some amount of climate control within the unit.

In all units, as desired, certain windows 37 or access openings 38 should be provided. Closures 39 for the openings 38 are also provided. Sliding windows fitted with the sliding screens 40 are preferred. Also, a protective cover 42 should be provided to protect against foul weather when the unit is not occupied or in case of imminent danger. Sliding doors may also be used as closures for the access openings.

Thus a very useful set of structures capable of multiple uses is provided. The set is readily portable over water surfaces and can provide living accommodations as well as recreational structures.

I claim as my invention:

1. A composite floating structure comprising a plurality of enclosed shelter units, flotation means beneath and in supporting relation to said shelter units, said floatation means being able to float and support said shelter units above the surface of a body of water, walkways extending between pairs of said units, linking means on each end of each of said walkways, matching linking means on said units, said linking means and matching linking means being loosely engaged whereby each unit is free to move vertically relative to each other unit.

2. The structure of claim 1 in which each of said shelter units has at least one edge adjacent a similar edge on an end of each walkway, said linking means and matching linking means being attached to said edges.

3. The structure of claim 2 in which said linking means are a ball and socket assembly, each ball being attached to an edge and each socket being attached to an edge adjacent said first named edge.

4. The structure of claim 2 in which said linking means and matching linking means include a ring shaped member attached to said one edge and to said similar edge, thus forming a pair of ring-shaped members, loop means extending through both members of said pair of members whereby said ring shaped members are loosely linked together.

5. The structure of claim 1 in which at least one of said flotation means is formed with at least one keel whereby motion of said structure longitudinally will be stabilized.

* * * * *